US006257137B1

(12) United States Patent
Witte

(10) Patent No.: US 6,257,137 B1
(45) Date of Patent: Jul. 10, 2001

(54) SCREEN PRINTING PROCESS

(75) Inventor: Edward Witte, Murrumbeena Victoria (AU)

(73) Assignee: Reefdale Proprietary Limited, Victoria (AU)

( * ) Notice: Subject to any disclaimer, the term of this patent is extended or adjusted under 35 U.S.C. 154(b) by 0 days.

(21) Appl. No.: 09/531,652

(22) Filed: Mar. 21, 2000

(30) Foreign Application Priority Data

May 6, 1999 (AU) ..... PQ0170

(51) Int. Cl.[7] ..... B41M 1/12
(52) U.S. Cl. ..... 101/129; 101/115
(58) Field of Search ..... 101/114, 115, 101/123, 126, 129

(56) References Cited

U.S. PATENT DOCUMENTS 5,483,811 1/1996 Miller ..... 101/126
5,592,877 1/1997 Szyszko et al. ..... 101/129
5,595,113 1/1997 Daniel et al. ..... 101/115
5,640,905 6/1997 Szyszko et al. ..... 101/129
5,678,482 10/1997 Daniel et al. ..... 101/129

*Primary Examiner*—Ren Yan
(74) *Attorney, Agent, or Firm*—Connolly Bove Lodge & Hutz LLP

(57) ABSTRACT

A method of operating a screen printing machine of the type where a number of garments supported on pallets sequentially move past a series of printing stations. In order to allow a sufficient delay between each print application the garments pass around the stations several times and in each lap only some of the colors are printed. The sequence is controlled by tracking the first garment and by activating counters at each active print head as the first garment arrives. The program allows for one process to complete while another commences and thus provides improved productivity.

6 Claims, 2 Drawing Sheets

SCREEN PRINTING PROCESS

FIELD OF THE INVENTION

This invention relates to improvements in operating multi color screen printing machines of the type where the substrate to be printed travels sequentially from one printing or curing station to the next.

BACKGROUND TO THE INVENTION

Screen printed garments are usually printed on rotary or oval multi print head machines in which the garments mounted on pallets are moved about the periphery of the machine where there are a series of print heads, curing stations and a load and an unload station. Patents relating to these machines include U.S. Pat. Nos. 4,407,195, 4,934,263, 5,154,119. Machines vary in size up to 20 stations which means there are up to 18 printing or curing heads plus the load and unload station. The operator sets up each print station with the appropriate screen, color and print settings before the garments are loaded. Usually the garments are printed in all the colors required and cured in one revolution of the machine.

Because of the complexity of the machine operation computer based control has become common. U.S. Pat. Nos. 5,483,881 and 5,678,482 are typical examples of the control systems employed.

In some cases the printed colors need to be cured before the next color is applied. Machines may not have sufficient print stations to accommodate all the curing and printing steps required. This problem has been overcome by carrying out the printing operation in more than one revolution of the machine. The machine is loaded with garments and in the first revolution all the garments are printed at certain heads only the time between the printing heads allowing the ink to cure. On the next revolution printing occurs at another set of heads and as many as 8 or 9 revolutions may be required to print the garments.

U.S. Pat. No. 5,595,113 is one attempt to provide a central programmed controller to assist the operator in carrying out this multi revolution printing sequence. The controller is programmed to select a printing station in a particular revolution, to index a garment to the selected print station, to determine whether the item is present at the print station and when the printing operation is complete. The controller stores the print head settings for each revolution in different buffers in the memory. In order to program the controller it is necessary to sequentially enter the revolution number, whether a head is active or inactive, whether it is a flash or print head and whether the print has one or two passes. Each pallet holding a garment is tracked by the controller and each station counts from the beginning of each revolution until the count equals the number of garments. This can be a cumbersome program. If an error is made in setting out the entire sequence the program must be deleted and re-entered. The controller senses the end of the operation by checking if there are any active heads in the next cycle and if not, the present revolution is the last. This is indicated to the operator by an alarm when the final revolution is half over so that the operator can commence unloading. A problem with this type of operation is that all the garments must be loaded before the printing sequence can begin and all the garments must be unloaded before the next sequence can begin. This makes the multi revolution printing process much more time consuming and costly.

It is an object of this invention to simplify the control program for multi revolution printing and to reduce the time taken for entering and a program and operating the machine, to improve productivity.

BRIEF DESCRIPTION OF THE INVENTION

To this end the present invention provides a method of controlling a multi-printhead screen printing machine where a plurality of pallets, adapted to carry a garment, sequentially move from a load station past each print head, which may be a print station, flash station or inactive, to an unload station, which includes the steps of a) loading at least one pallet with a garment
b) identifying the first garment loaded at the load station as garment number 1
c) setting at least one print head into active mode
d) providing functional settings to said active printhead
e) moving said pallets until garment number 1 arrives at the first active printhead
f) setting a counter on said first active print head to a value of y where y is the number of garments to be loaded on the machine
g) carrying out the functions set at said first active printhead
h) moving said pallet with said garment number 1 to the next printhead and changing the counter on said first active head to y−1
i) continuing the sequence e) to h) for each active print head as the pallets move from one print head to another until the counter value at each active print head is zero
j) changing to the next cycle when the pallet number 1 leaves the load station and repeating steps c) to i) for each cycle until all cycles are completed
k) and unloading the printed garments from the pallets.

Preferably step j) commences before step l) is completed so that garment number 1 commences the next cycle while the other garments finish the cycle. The advantage of this method is that unlike the prior art it avoids tracking all of the pallets and is thus more economical in its use of computing power.

It is usual with multi lap printing that all garments have to be unloaded before a new process sequence of laps [cycles] can commence. This means that with the last lap, the unloaded pallets have to pass another lap before they are reloaded with new garments.

Throughout this specification the term "print head" refers to the location on the machine at which screen printing usually occurs but which may be substituted with a flash cure or other ink curing device.

In another aspect the present invention provides a method of controlling a multi-printhead screen printing machine where a plurality of pallets, adapted to carry a garment, sequentially move in a plurality of index steps from a load station past each print head, which may function as a print or cure station, to an unload station, wherein the process of completely printing all the garments requires the garments to pass the unload station without being removed and to pass the print heads in at least one further lap, with a different set of print heads being active in each lap, in which the process steps include a) maintaining in a first register the total number of index steps required for each process to be completed wherein the total=(y+1)n−1 where y is the number of laps and n is the number of pallets b) maintaining in a second register a record of the location of the first garment to leave the load station as the pallets are indexed past the printheads in a plurality of laps c) maintaining in a third register a record of which pallets have garments d) maintaining at each print head a counter for the garments to be printed and reducing this number by 1 with each index of a lap e) each printhead being functional when the value in the printhead counter is greater than 0 f) the garments being loaded onto the pallets during the first lap of the process such that at the end of the first lap the first loaded garment has been treated at each active print head while the last loaded garment has not yet moved to an active printhead g) optionally, when the first loaded garment has completed y.n−2 indexes signal means at the unload station indicates that the garment may be removed h) after y.n indexes, the second register is reset to commence tracking the first garment of a new process sequence, and the third register is reset sequentially as new garments are loaded so that during the first lap of the new process sequence the last lap of the preceding process sequence is completed.

This has the advantage that operator idle time between process sequences is eliminated. Where the number of laps is 3 this results in a 25% increase in output over a given time period. It has been found that the most common number of laps is 3 however the number could be as great as the number of print heads on the machine eg 8 for an eight color machine which has 10 pallets, a load and an unload station and eight printheads or curing stations.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Figure 1:
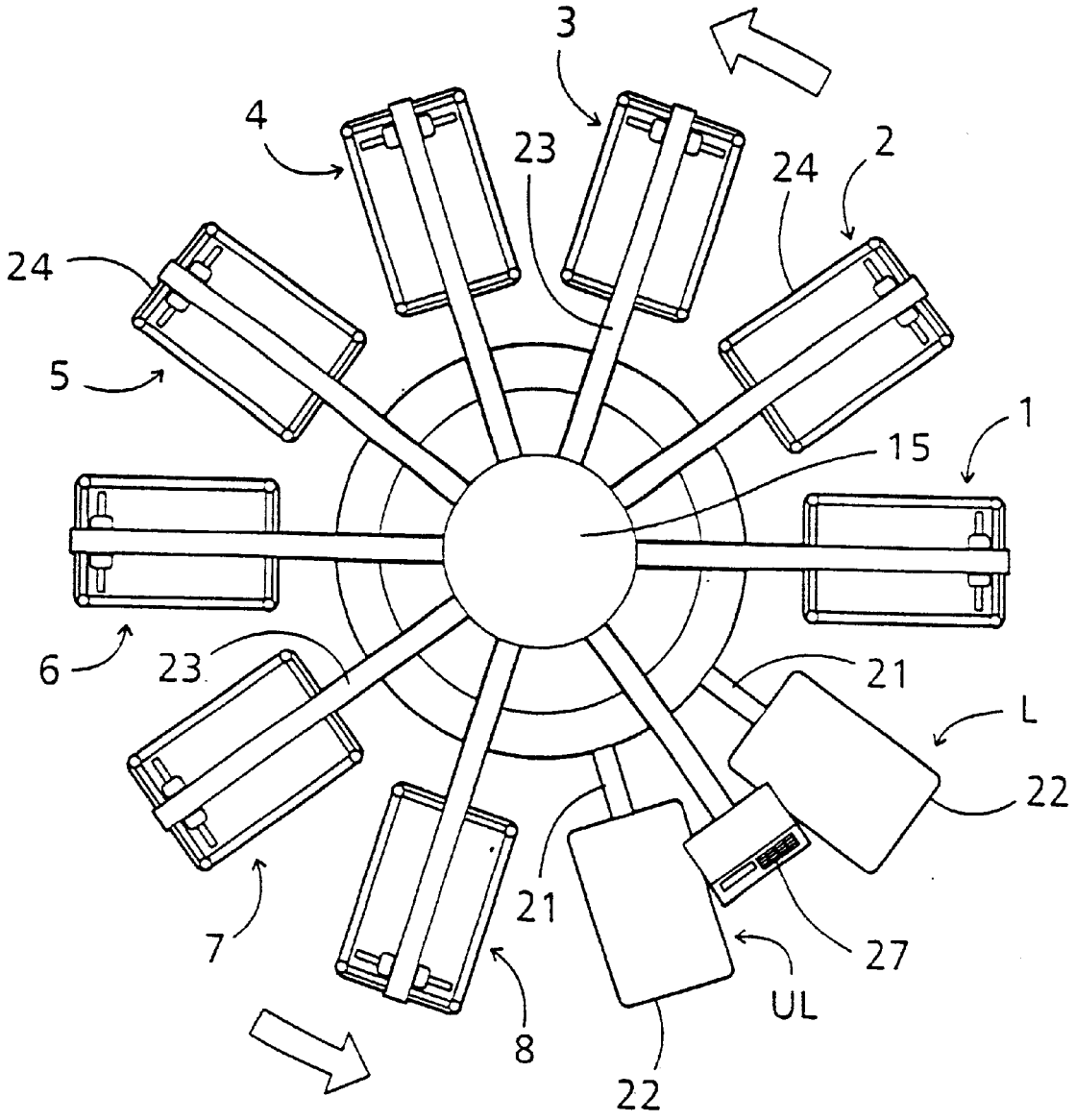
FIG. 1 is a schematic plan view of a conventional garment screen printing machine which can be operated according to the present invention.

A preferred embodiment of the invention will be described with reference to the drawing [FIG. 1] which is a schematic plan view of a conventional garment screen printing machine which can be operated according to the process of the present invention. In the machine illustrated the pallets rotate in a counterclockwise fashion but it is equally possible for the machine to function with clockwise rotation of the pallets.

The screen printing machine comprises a rotatable set of ten pallet arms 21 which are mounted for rotation about a central column 15. Each pallet arm 21 carries a garment pallet 22. Garments are fitted onto the pallets.

Figure 2:
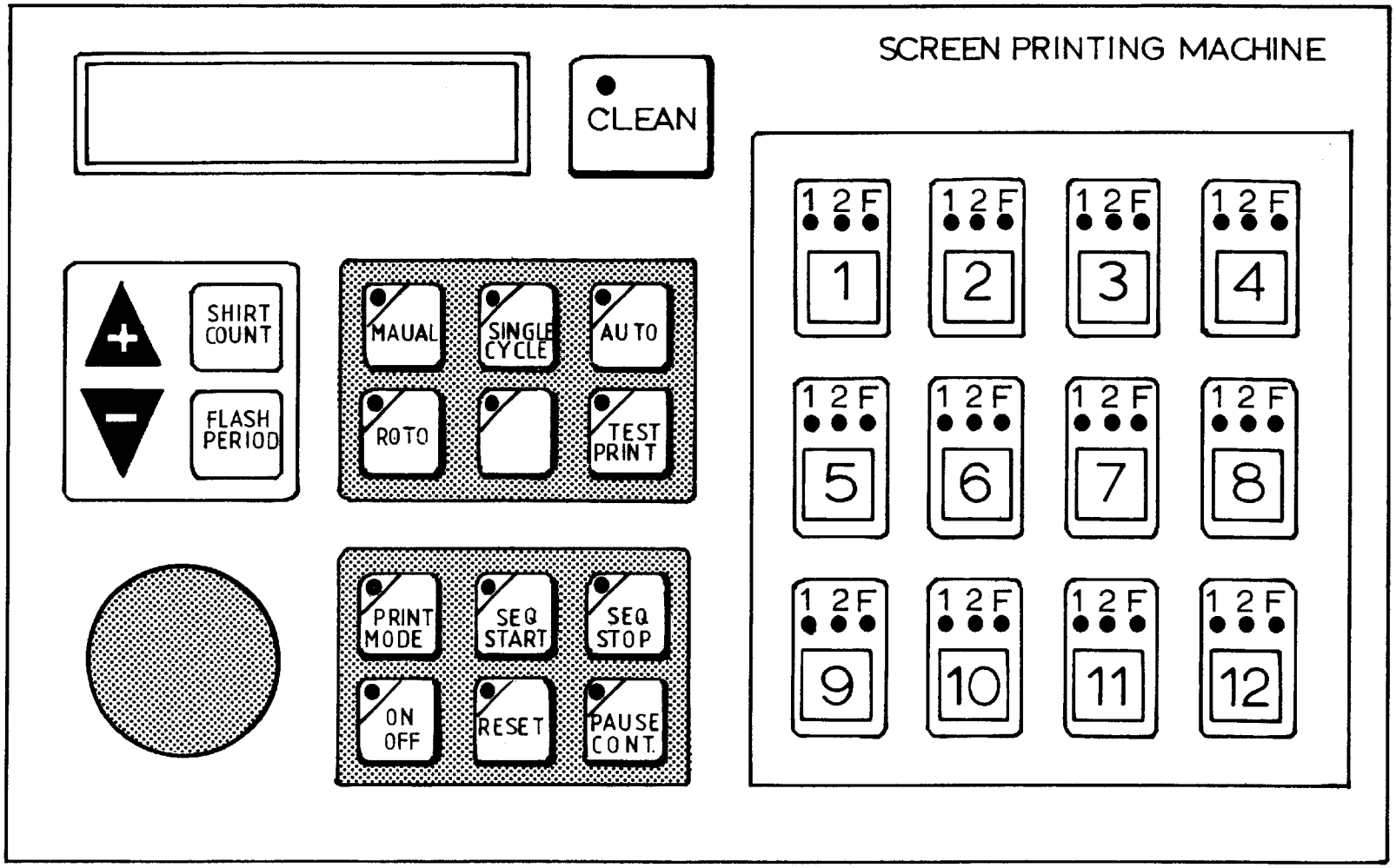
FIG. 2 is a detailed view of the control panel of the machine of FIG. 1.

Above the pallets are a set of eight printheads 24 mounted on fixed printhead support arms 23 which also radiate from the central column 15. The print heads are numbered from 1 to 8 and the load station L and the unload station UL are located between printheads 1 and 8. The pallet arms 21 rotate in a counterclockwise direction as shown by the arrow. Each rotation is indexed so that each pallet moves sequentially from one station to the next. Each contains controls [not shown] relating to the operation of the printhead such as on/off, print length, flood and squeegee pressure and speed, the number of print strokes and flash cure controls. As is conventional, the print heads can be substituted by flash cure units. Between the load station L and the unload station UL where the operator stands, is a central control panel 27, as illustrated in FIG. 2.

This type of screen printing machine can be of any conventional design and the number of print heads or cure stations can vary.

One embodiment of the present invention will be described with reference to a ten pallet eight printhead machine of the type illustrated in FIG. 1. The operational sequence will be described with reference to table 1 which sets out the key parameters of the process in a four cycle printing process where ten garments are printed in eight colors without using flash curing units but relying on the delay between each application of ink to provide sufficient drying of the ink between each color application. In the first cycle [revolution] print heads 1 and 5 are active; in cycle two printheads 2 and 6 are active; in cycle 3 printheads 3 and 7 are active and finally in cycle four printheads 4 and 8 are active. As will be seen in the description below the advantage of the present invention is that different heads will be in different cycles at any particular indexation and the cycles may be in different process batches.

At the beginning of the process the operational program is either keyed in to the central programmer or is loaded from a pre-recorded program. The heads may be switched on individually at the beginning of the process by activating the on/off switch at each head or they can be switched on from the central controller. The control panel may be any conventional panel incorporating a programmable controller and display panel. Ideally there is a display for each print head so that each print head can be set to one of the following values a) inactive
b) print one pass
c) print one pass plus flash
d) print 2 passes
e) print 2 passes plus flash
f) print 3 passes
g) print 3 passes plus flash or
h) flash If a printhead is set to command c) or e) the next active print head in the cycle is a flash station. If it is set to flash then the print station is functioning as a flash curing station.

Each head has a counter and if no printing is to occur the counter is set at 0. The setting of the counters to a real value is a function of the printing program in the central controller. The default setting once printing is to occur is the maximum number of garments that can be printed in one cycle, namely ten. However the operator can alter this to any integer between one and ten. Small batches are usually used to test the quality of printing before commencing production of a large batch.

During the steps of programming the sequence it is possible at any time, prior to starting the program, to move to any lap number and any printhead and change the printhead setting without having to re-enter all the values for all heads. When the central controller is loaded with the program the operator loads the first garment and starts the machine which carries out the first indexation which moves garment 1 to station 1. In the program as set out in table 1 the first indexation also sets the counter at printing head 1 at ten [10]. The operator loads the second garment onto the pallet at the load station.

On the second indexation the counter at printing head 1 changes to nine [9]. The first garment arrives at printing head 2 where the counter is set at 0 and no printing occurs. The second garment arrives at printing head 1 and is printed. The operator loads the third garment onto the pallet at the load station.

On the third indexation the counter at printing head 1 changes to eight [8]. The first garment arrives at printing head 3 where the counter is set at 0 and no printing occurs. The second garment arrives at printing head 2 which is set at 0 and no printing occurs. The third garment arrives at printing head 1 and is printed. The operator loads the fourth garment onto the pallet at the load station.

On the fourth indexation the counter at head 1 reduces to 7 and the fourth garment arrives at printing head 1 and is printed. Garments 1,2 and 3 respectively arrive at heads 4, 3 and 2 which are all set to 0 and no printing occurs. The operator loads the fifth garment on to the pallet at the load station.

On the fifth indexation the counter at head 1 reduces to 6 and the counter at head 5 is set to 10. Garment 1 arrives at head 5 and is printed. Garment 5 arrives at head 1 and is printed. Garments 2, 3 and 4 are at heads 4, 3 and 2 respectively and are not printed.

The indexations proceed sequentially so at the ninth indexation garment I is at the unload station, garment nine is at printhead 1 and is printed, and garment five is at head 5 and is printed. The operator loads garment 10 at the load station so that now at the end of the first cycle all the pallets are loaded.

The next indexation completes the first cycle and garment one is at the load station. The operator may now leave the machine to complete the four cycles and will not be needed until garment one reaches the unload station the fourth time. In this last indexation of cycle one garment ten is being printed at printhead 1 and is garment six is at print head 5.

The next indexation is the first of cycle two and garment one is again at printhead 1 but is not printed because the counter at print head 1 is now zero [0].

The second indexation of cycle two brings garment one to printhead 2 and sets the counter at print head2 to ten. Garment one is printed with its third color at printhead 2.

The indexation proceeds sequentially and at the fifth indexation of cycle two the counter of print head 5 is reduced to zero and garment one arrives at printhead 5 and is not printed.

On the sixth indexation of cycle 2 the counter at printhead 6 is set to ten and garment one is printed with its fourth color at printhead 6.

When garment one arrives at the load station after the tenth and final indexation of cycle two, the second cycle is complete and heads 2 and 6 are still active.

The next indexation commences cycle three. Printhead 2 completes its printing after the second index of cycle 3. On the third indexation of cycle three the counter at print head 3 is set to ten and garment one receives its fifth color at printhead 3.

On the sixth indexation of the third cycle the counter at head 6 reduces to zero. Garment one moves from head 6 to head 7 on the seventh indexation of cycle 3 and the counter at head seven is set to ten. The sixth color is then printed on garment one at head 7.

When Garment one arrives at the load station on the tenth indexation of cycle three heads 3 and 7 are active with their counters set at 3 and 7 respectively.

TABLE 1

| Garment 1 | Head 1 count | Head 2 count | Head 3 count | Head 4 count | Head 5 count | Head 6 count | Head 7 count | Head 8 count |
|---|---|---|---|---|---|---|---|---|
| Cycle 1 | active | Inactive | Inactive | Inactive | active | Inactive | Inactive | Inactive |
| At load* | 0 | 0 | 0 | 0 | 0 | 0 | 0 | 0 |
| Head 1 | 10* | 0 | 0 | 0 | 0 | 0 | 0 | 0 |
| Head 2 | 9 | 0* | 0 | 0 | 0 | 0 | 0 | 0 |
| Head 3 | 8 | 0 | 0* | 0 | 0 | 0 | 0 | 0 |
| Head 4 | 7 | 0 | 0 | 0* | 0 | 0 | 0 | 0 |
| Head 5 | 6 | 0 | 0 | 0 | 10* | 0 | 0 | 0 |
| Head 6 | 5 | 0 | 0 | 0 | 9 | 0* | 0 | 0 |
| Head 7 | 4 | 0 | 0 | 0 | 8 | 0 | 0* | 0 |
| Head 8 | 3 | 0 | 0 | 0 | 7 | 0 | 0 | 0* |
| Unload* | 2 | 0 | 0 | 0 | 6 | 0 | 0 | 0 |
| Load* | 1 | 0 | 0 | 0 | 5 | 0 | 0 | 0 |
| Cycle 2 | inactive | active | inactive | inactive | Inactive | active | inactive | Inactive |
| Head 1 | 0* | 0 | 0 | 0 | 4 | 0 | 0 | 0 |
| Head 2 | 0 | 10* | 0 | 0 | 3 | 0 | 0 | 0 |
| Head 3 | 0 | 9 | 0* | 0 | 2 | 0 | 0 | 0 |
| Head 4 | 0 | 8 | 0 | 0* | 1 | 0 | 0 | 0 |
| Head 5 | 0 | 7 | 0 | 0 | 0* | 0 | 0 | 0 |
| Head 6 | 0 | 6 | 0 | 0 | 0 | 10* | 0 | 0 |
| Head 7 | 0 | 5 | 0 | 0 | 0 | 9 | 0* | 0 |

TABLE 1-continued

| Garment 1 | Head 1 count | Head 2 count | Head 3 count | Head 4 count | Head 5 count | Head 6 count | Head 7 count | Head 8 count |
|---|---|---|---|---|---|---|---|---|
| Head 8 | 0 | 4 | 0 | 0 | 0 | 8 | 0 | 0* |
| Unload* | 0 | 3 | 0 | 0 | 0 | 7 | 0 | 0 |
| Load* | 0 | 2 | 0 | 0 | 0 | 6 | 0 | 0 |

the term active or inactive indicates the status of the print head when the first garment arrives. The print head remains active until the counter is zero.
The * indicates the location of the first garment

| Garment 1 | Head 1 count | Head 2 count | Head 3 count | Head 4 count | Head 5 count | Head 6 count | Head 7 count | Head 8 count |
|---|---|---|---|---|---|---|---|---|
| Cycle 3 | inactive | inactive | active | Inactive | inactive | Inactive | active | inactive |
| Head 1 | 0* | 1 | 0 | 0 | 0 | 5 | 0 | 0 |
| Head 2 | 0 | 0* | 0 | 0 | 0 | 4 | 0 | 0 |
| Head 3 | 0 | 0 | 10* | 0 | 0 | 3 | 0 | 0 |
| Head 4 | 0 | 0 | 9 | 0* | 0 | 2 | 0 | 0 |
| Head 5 | 0 | 0 | 8 | 0 | 0* | 1 | 0 | 0 |
| Head 6 | 0 | 0 | 7 | 0 | 0 | 0* | 0 | 0 |
| Head 7 | 0 | 0 | 6 | 0 | 0 | 0 | 10* | 0 |
| Head 8 | 0 | 0 | 5 | 0 | 0 | 0 | 9 | 0* |
| Unload* | 0 | 0 | 4 | 0 | 0 | 0 | 8 | 0 |
| Load* | 0 | 0 | 3 | 0 | 0 | 0 | 7 | 0 |
| Cycle 4 | inactive | inactive | inactive | active | inactive | inactive | inactive | active |
| Head 1 | 0* | 0 | 2 | 0 | 0 | 0 | 6 | 0 |
| Head 2 | 0 | 0* | 1 | 0 | 0 | 0 | 5 | 0 |
| Head 3 | 0 | 0 | 0* | 0 | 0 | 0 | 4 | 0 |
| Head 4 | 0 | 0 | 0 | 10* | 0 | 0 | 3 | 0 |
| Head 5 | 0 | 0 | 0 | 9 | 0* | 0 | 2 | 0 |
| Head 6 | 0 | 0 | 0 | 8 | 0 | 0* | 1 | 0 |
| Head 7 | 0 | 0 | 0 | 7 | 0 | 0 | 0* | 0 |
| Head 8 | 0 | 0 | 0 | 6 | 0 | 0 | 0 | 10* |
| Unload* | 0 | 0 | 0 | 5 | 0 | 0 | 0 | 9 |
| Load* | 0 | 0 | 0 | 4 | 0 | 0 | 0 | 8 |
| NEW | | | | | | | | |
| Cycle 1 | active | inactive | inactive | inactive | active | inactive | inactive | inactive |
| Head 1 | 10** | 0 | 0 | 3 | 0 | 0 | 0 | 7 |
| Head 2 | 9 | 0** | 0 | 2 | 0 | 0 | 0 | 6 |
| Head 3 | 8 | 0 | 0** | 1 | 0 | 0 | 0 | 5 |
| Head 4 | 7 | 0 | 0 | 0** | 0 | 0 | 0 | 4 |
| Head 5 | 6 | 0 | 0 | 0 | 10** | 0 | 0 | 3 |
| Head 6 | 5 | 0 | 0 | 0 | 9 | 0** | 0 | 2 |
| Head 7 | 4 | 0 | 0 | 0 | 8 | 0 | 0** | 1 |
| Head 8 | 3 | 0 | 0 | 0 | 7 | 0 | 0 | 0** |
| Unload ** | 2 | 0 | 0 | 0 | 6 | 0 | 0 | 0 |
| Load** | 1 | 0 | 0 | 0 | 5 | 0 | 0 | 0 |

the term active or inactive indicates the status of the print head when the first garment arrives. The print head remains active until the counter is zero.
The **indicates the location of the first garment of the second process.

The next indexation is the first of the fourth and final cycle. On the third indexation of the fourth cycle the counter on printing head 3 is reduced to zero with the arrival of garment one.

On the fourth indexation of the fourth cycle the counter at head 4 is set to ten and garment one is printed with its seventh color.

On the sixth indexation of the fourth cycle the operator is notified that the first garment will be at the unload station after 3 indexations by a display such as flashing lights or a sound signal.

Garment one arrives at head 7 on the seventh indexation as the counter of head 7 falls to zero. The alarm at the unload station beeps and/or flashes twice.

The next indexation is the eighth of the fourth cycle and sets the counter at head 8 to ten. Garment one is now printed with its eighth and final color at head 8.

The alarm at the unload station beeps and/or flashes once to warn the operator to return to the unload station.

On the ninth indexation of the fourth cycle garment one arrives at the unload station where it is removed. Garment one has completed 39 indexes which is one less than the number of cycles times the number of garments.

On the tenth indexation of the fourth cycle a new garment from a second process batch is placed on the empty pallet in the load station. This new garment will now commence the first cycle of the printing process on the next indexation.

This next indexation is the first of a new cycle where heads 1 and 4 will become active. The new garment, one of the second batch is printed at head one and a second garment of this second process batch is added at the load station as garment two of the first process batch is removed at the unload station.

Printing of the remaining garments of the first process continues on print heads 4 and 8. Printing at head 4 ceases on the fourth indexation of the first cycle of the second process. Printing at head eight ceases on the eighth indexation of this first cycle of the second process. The last garment of the first process is removed at the unload station as the first garment of the second process arrives at head 8. The last garment of the first process has undergone 39 indexes and in all there has been 48 indexes in the 4 cycles before the last garment is at the unload station for removal. The status of all the print heads is now the same as at the eighth index of the first cycle of the first process and the sequence will be identical from this point forward. The forty ninth index brings the pallet which carried the last garment of the first process to the load station so that the tenth and last garment of the second process can be loaded. This completes the first process.

The printing operation carried out at each active station can be set at the print head controller or from the central controller. The parameters that can be varied from one print head to the next are print length, print speed, flood bar and squeegee settings and whether the printer has been replaced with a flash cure unit.

The advantage that this process has over the prior art is that there is no need to track all ten garments, just the first garment. The arrival of the first garment at an active head sets the counter to ten and there is no need to count at all heads, just those with a count above zero.

What is claimed is:

1. A method of controlling a multi-printhead screen printing machine where a plurality of pallets, adapted to carry a garment, sequentially move, in a single rotational direction, from a load station past each print head, which may be a print station, flash station or inactive, to an unload station, each complete rotation of a pallet defining a cycle, the method including the steps of:

a) loading at least one pallet with a garment to initiate a first cycle;

b) identifying the first garment loaded at a load station as garment number 1;

c) setting at least one print head into active mode;

d) providing functional settings to said active printhead;

e) moving said pallets sequentially until garment number 1 arrives at the first active printhead;

f) setting a counter on said first active print head to a value of y where y is the number of garments to be loaded on the machine;

g) carrying out the functions set at said first active printhead;

h) moving said pallet with said garment number 1 to the next printhead and changing the counter on said first active head to y−1;

i) continuing the sequence e) to h) for each active print head as the pallets move from one print head to another until the counter value at each active print head is zero;

j) beginning a next cycle when the garment number 1 again leaves the load station and repeating steps c) to j) for each succeeding cycle until all cycles are completed; and k) unloading the printed garments from the pallets.

2. A method as claimed in claim 1, further including the step of setting each print head to one of the following possible values a) inactive b) print one pass c) print one pass plus flash d) print 2 passes e) print 2 passes plus flash f) print 3 passes g) print 3 passes plus flash h) flash wherein if a printhead is set to command c) or e) the next active print head in the cycle is a flash station.

3. A method of controlling a multi-printhead screen printing machine where a plurality of pallets, adapted to carry a garment, sequentially move in a plurality of index steps and in a single rotational direction from a load station past each print head to an unload station, each complete rotation defining a cycle, and the process of completely printing all the garments requires the garments to pass the unload station without being removed and to pass the print heads in at least one further cycle, with a different set of print heads being active in each cycle, in which the process steps include:

a) maintaining in a first register the total number of index steps required for each process to be completed wherein the total=(y+1)n−1 where y is the number of cycles and n is the number of pallets;

b) maintaining in a second register a record of the location of the first garment to leave the load station as the pallets are indexed past the printheads in a plurality of cycles;

c) maintaining at each print head a count of the number of pallets and reducing this number by 1 with each index of a cycle in which the print head is active;

d) the garments being loaded onto the pallets during a first cycle of the process such that at the end of the first cycle the first loaded garment has been treated at each active print head while the last loaded garment has not yet moved to an active printhead;

e) after y.n indexes, the second register is reset to commence tracking the first garment of a new process sequence, so that during the first cycle of the new process sequence the last cycle of the preceding process sequence is completed.

4. A method as claimed in claim 3 wherein each print head is functional when the value in the printhead counter is greater than 0.

5. A method as claimed in claim 3 wherein, when the first loaded garment has completed y.n−2 indexes, signal means at the unload station indicates that the garment may be removed.

6. A method as claimed in claim 3, further including the step of setting each print head to one of the following possible values a) inactive b) print one pass c) print one pass plus flash d) print 2 passes e) print 2 passes plus flash f) print 3 passes g) print 3 passes plus flash h) flash wherein if a printhead is set to command c) or e) the next active print head in the cycle is a flash station.

* * * * *